US009748708B2

(12) United States Patent
Mostoller et al.

(10) Patent No.: US 9,748,708 B2
(45) Date of Patent: Aug. 29, 2017

(54) POKE-IN ELECTRICAL CONNECTOR

(71) Applicant: Honeywell International Inc., Morris Plaines, NJ (US)

(72) Inventors: Matthew Edward Mostoller, Hummelstown, PA (US); Edward John Howard, Millersburg, PA (US); Christopher George Daily, Harrisburg, PA (US); David J. Emmons, Plymouth, MN (US); Travis Read, Little Canada, MN (US); Steven L. Wolff, Hamel, MN (US); Eric Barton, Eden Prairie, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/513,577

(22) Filed: Oct. 14, 2014

(65) Prior Publication Data

US 2016/0104981 A1 Apr. 14, 2016

(51) Int. Cl.
*H01R 13/707* (2006.01)
*H01R 13/629* (2006.01)
(Continued)

(52) U.S. Cl.
CPC ..... *H01R 13/707* (2013.01); *H01H 13/14* (2013.01); *H01R 4/4836* (2013.01);
(Continued)

(58) Field of Classification Search
CPC .. H01R 12/7076; H01R 13/14; H01R 4/4836; H01R 13/62933
(Continued)

(56) References Cited

U.S. PATENT DOCUMENTS 3,152,851 A * 10/1964 McLaughlin ..... H01H 85/205 439/441
6,102,749 A * 8/2000 Lynn ..... G05D 23/1902 439/810
(Continued)

FOREIGN PATENT DOCUMENTS

DE 10 2012 005465 B3 5/2013
DE 20 2013 101582 U1 7/2014
(Continued)

OTHER PUBLICATIONS

International Search Report, International Application No. PCT/US2015/054208, International Filing Date, Oct. 6, 2015.

*Primary Examiner* — Felix O Figueroa
(74) *Attorney, Agent, or Firm* — Seager, Tufte & Wickhem, LLP

(57) ABSTRACT

An electrical connector includes a housing having contact channels with electrical contacts received therein each having a poke-in spring beam configured to engage an electrical wire when poked-in to the housing. The electrical contact is movable between a resting position when no wire is present in the wire channel and a clearance position where the electrical contact allows the electrical wire to be removed from the wire channel. Pivot levers are held by the housing and are coupled to corresponding electrical contacts with a pivot end pivotably coupled to the housing and a push button end having a push button pressed to move the corresponding electrical contact to the clearance position. When the electrical wire is loaded into the wire channel, the electrical contact is positioned in a pinching position in which the spring beam pinches against the electrical wire in physical contact with the electrical wire.

19 Claims, 5 Drawing Sheets

(51) Int. Cl.
*H01H 13/14* (2006.01)
*H01R 12/70* (2011.01)
*H01R 4/48* (2006.01)

(52) U.S. Cl.
CPC ... *H01R 12/7076* (2013.01); *H01R 13/62933* (2013.01); *H01H 2201/00* (2013.01)

(58) Field of Classification Search
USPC ..... 439/441, 835
See application file for complete search history.

(56) References Cited

U.S. PATENT DOCUMENTS 7,344,422 B2 * 3/2008 Helmreich ..... H01H 50/14
439/835
8,262,422 B1 9/2012 Chiang

FOREIGN PATENT DOCUMENTS

EP 1 622 224 A1 2/2006
FR 2 935 201 A1 2/2010

* cited by examiner

POKE-IN ELECTRICAL CONNECTOR

BACKGROUND OF THE INVENTION

The subject matter described herein relates generally to a poke-in electrical connector for terminating electrical wires.

Some electrical connectors that terminate electrical wires include terminal blocks that pivot between open and closed positions. In the open position, the terminal blocks are oriented to receive the ends of corresponding electrical wires, which may be stripped to expose the conductors thereof. The terminal blocks are pivoted from the open positions to the closed positions to engage the electrical conductors of the electrical wires in electrical connection with corresponding electrical contacts of the electrical connector.

Pivot block style connectors are not without their disadvantages. For example, the electrical contacts of at least some known pivot block style connectors require the use of a separate compliant spring to hold the electrical contact in physical contact with the wire. Such connectors require multiple parts and may have high spring force. Such connectors tend to buckle smaller wires when the wires are poked-in to the connector.

SUMMARY OF THE INVENTION

In an embodiment, an electrical connector is provided that includes a housing having contact channels and wire channels open to corresponding contact channels. The wire channels are configured to receive an electrical wire during a poke-in termination. Electrical contacts are received in corresponding contact channels and held by the housing. Each electrical contact includes a poke-in spring beam configured to engage the electrical wire when poked-in to the corresponding wire channel. The spring beam has a separable wire interface configured to engage in physical contact with the electrical wire. The electrical contact is movable between a resting position when no wire is present in the wire channel and a clearance position where the electrical contact allows the electrical wire to be removed from the wire channel. Pivot levers are held by the housing and are coupled to corresponding electrical contacts. The pivot levers move with the corresponding electrical contacts. Each pivot lever extends between a pivot end and a push button end. The pivot end is pivotably coupled to the housing and the push button end has a push button configured to be pressed in a pressing direction by an operator to move the corresponding electrical contact to the clearance position. When the electrical wire is loaded into the wire channel, the electrical contact is positioned in a pinching position between the clearance position and the resting position in which the spring beam pinches against the electrical wire in physical contact with the electrical wire.

In another embodiment, a thermostat assembly is provided that includes a thermostat having a printed circuit having mating contacts and an electrical connector configured to be mated with the thermostat. The electrical connector includes a housing having contact channels and wire channels open to corresponding contact channels. The wire channels are configured to receive an electrical wire during a poke-in termination. Electrical contacts are received in corresponding contact channels and held by the housing. Each electrical contact includes a poke-in spring beam configured to engage the electrical wire when poked-in to the corresponding wire channel. The spring beam has a separable wire interface configured to engage in physical contact with the electrical wire. The electrical contact is movable between a resting position when no wire is present in the wire channel and a clearance position where the electrical contact allows the electrical wire to be removed from the wire channel. The electrical contact includes pin beams directly electrically connected to the corresponding mating contact. Pivot levers are held by the housing and are coupled to corresponding electrical contacts. The pivot levers move with the corresponding electrical contacts. Each pivot lever extends between a pivot end and a push button end. The pivot end is pivotably coupled to the housing and the push button end has a push button configured to be pressed in a pressing direction by an operator to move the corresponding electrical contact to the clearance position. When the electrical wire is loaded into the wire channel, the electrical contact is positioned in a pinching position between the clearance position and the resting position in which the spring beam pinches against the electrical wire in physical contact with the electrical wire.

DETAILED DESCRIPTION OF THE DRAWINGS

Figure 1:
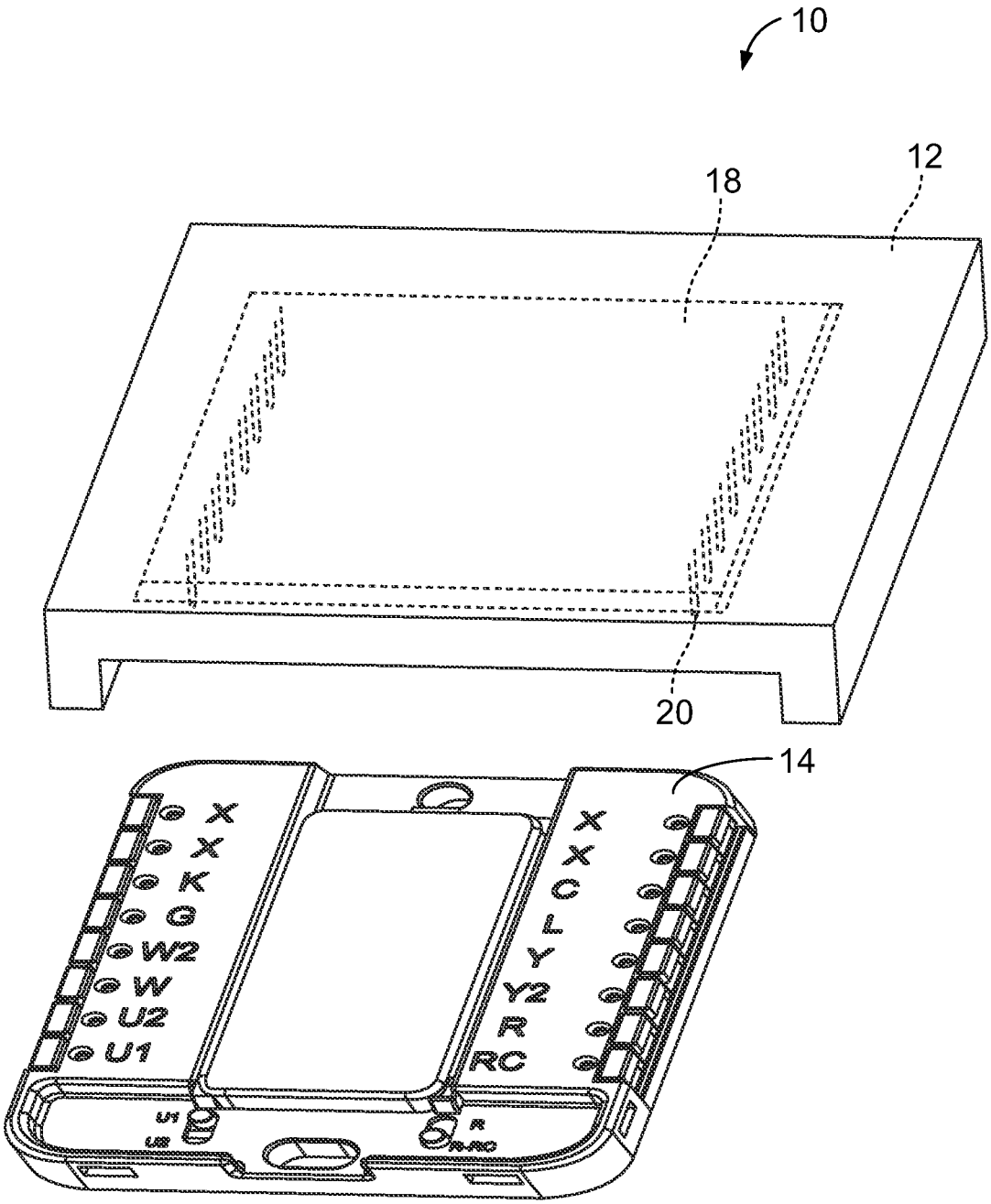
FIG. 1 is an exploded perspective view of an embodiment of a thermostat assembly.

FIG. 1 is an exploded perspective view of an embodiment of a thermostat assembly 10. The thermostat assembly 10 includes a thermostat 12 and an electrical connector 14. The electrical connector 14 is configured to be mounted to a wall and electrical wires 16 (shown in FIG. 2) may extend from the wall for termination to the electrical connector 14. The thermostat 12 is configured to be mounted to the electrical connector 14 such that the electrical connector 14 is electrically connected with the thermostat 12 and the thermostat 12 is mounted to the wall. But, the electrical connector 14 may be mated with the thermostat 12 in any other configuration, arrangement, and/or the like. For example, in some embodiments the thermostat 12 and/or the electrical connector 14 are not mounted to a wall, but rather are mounted to another surface, such as, but not limited to, a floor, a ceiling, a piece of furniture, a fixture, another structure, and/or the like. In alternative embodiments, the electrical connector 14 may be electrically connected to another type of electronic component other than the thermostat 12. For example, the electrical connector 14 may be terminated to a printed circuit board and may electrically connect wires to the printed circuit board. The use of the electrical connector 14 is not limited to use in a thermostat assembly 10.

The thermostat 12 includes a printed circuit 18 having mating contacts 20. As will be described below, electrical contacts 22 (shown in FIG. 3) of the electrical connector 14 are configured to be mated with the mating contacts 20 of the thermostat 12 to establish an electrical connection between the electrical connector 14 and the thermostat 12. For example, the mating contacts 20 may be plugged into the electrical connector 14 for mating with the electrical contacts 22 held in the electrical connector 14. The electrical connector 14 electrically connects the electrical wires 16 with the printed circuit 18 of the thermostat 12 via the electrical contacts 22 and the mating contacts 20.

Although the electrical connector 14 is shown as defining a portion of the thermostat assembly 10, the electrical connector 14 is not limited to being used as a portion of a thermostat assembly. Rather, the electrical connector 14 additionally or alternatively may mate with any other device besides a thermostat and may be used to terminate electrical wires for any other electrical device besides a thermostat assembly. The thermostat assembly 10 and the thermostat 12 (not shown in FIG. 2) are meant as only one exemplary application of the electrical connector 14.

Figure 2:
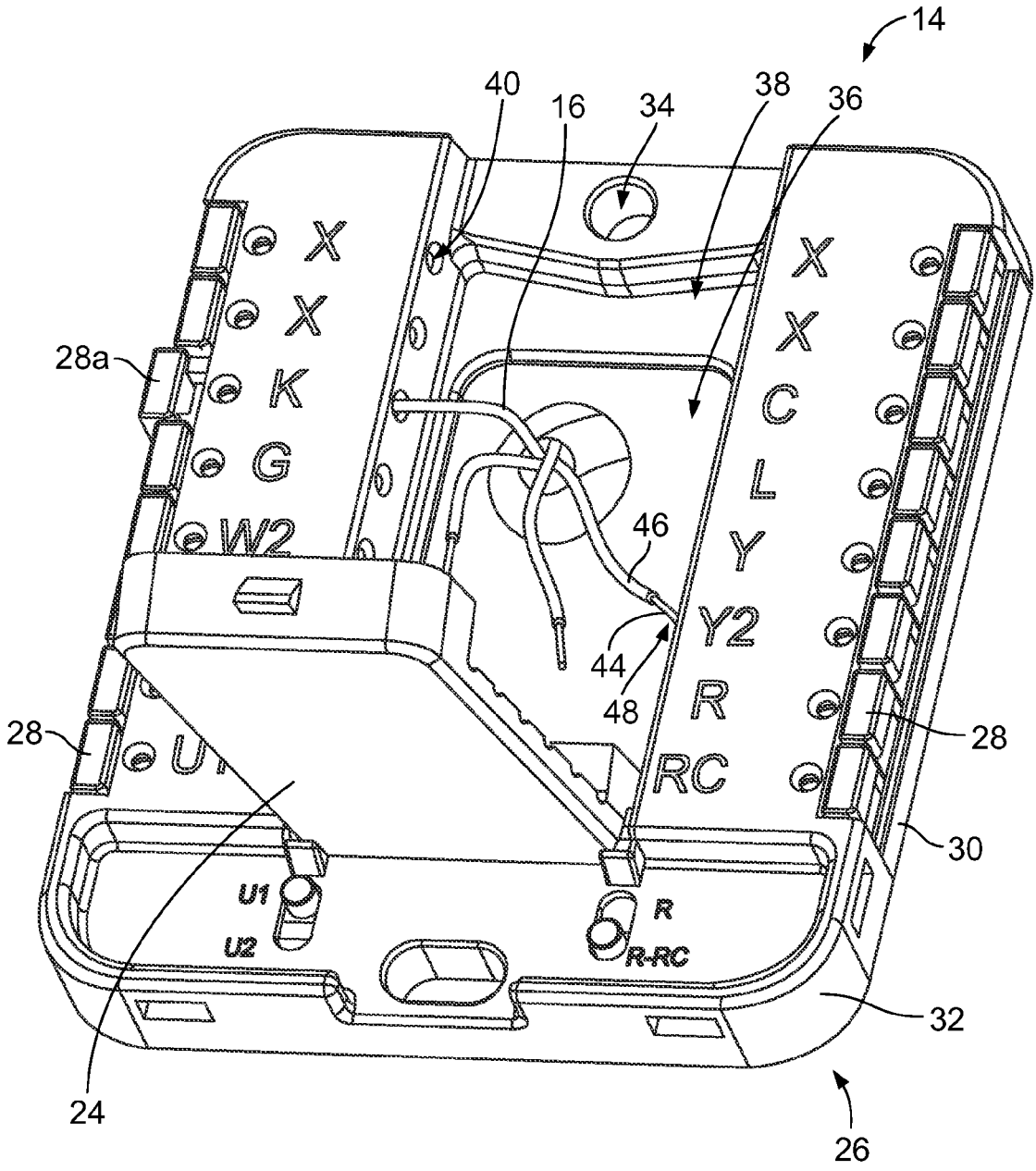
FIG. 2 is a perspective view of an embodiment of an electrical connector of the thermostat assembly.

FIG. 2 is a perspective view of an embodiment of the electrical connector 14. The electrical connector 14 includes a cover 24 that may be pivoted open to expose the electrical wires 16. The electrical connector 14 is a poke-in style connector that allows the electrical wires 16 to be poked-in to the electrical connector 14 for termination to the electrical contacts 22 (shown in FIG. 3). Optionally, the electrical wires 16 are grouped together in a cable (not shown).

The electrical connector 14 includes a housing 26, which holds the electrical contacts 22, and pivot levers 28 that are movable with the electrical contacts 22, such as to release the electrical wires 16 for removal of the electrical wires 16 from the housing 26. The electrical contacts 22 and the pivot levers 28 are held by the housing 26. In the illustrated embodiment, the housing 26 includes a base plate 30 and a cover plate 32. The base plate 30 and the cover plate 32 also define a wall plate assembly in the illustrated embodiment for mounting the electrical connector 14 to a wall. In alternative embodiments, the housing 26 may be devoid of the base plate 30, but rather may be mounted to another structure, such as a printed circuit board. The plate(s) 30 and/or 32 may include openings 34 and/or other features that facilitate mounting the electrical connector 14 on the wall and/or other surface. The plates 30, 32 include respective openings 36, 38 for receiving the electrical wires 16. The cover plate 32 includes a plurality of wire channels 40 that are configured to receive the electrical wires 16. For example, the electrical wires 16 may be poked-in to any of the wire channels 40 for termination to the corresponding electrical contact 22. The housing 26 additionally or alternatively may have other configurations, arrangements, structures, geometries, and/or the like, which may depend on the particular application of the electrical connector 14.

The pivot levers 28 are held by the cover plate 32 of the housing 26 such that the pivot levers 28 are pivotable between a normal or resting position, in which the pivot levers 28 are in an outward position (as compared to the wall or other mounting structure), and a release position, in which the pivot levers 28 are pressed inward to an inward position (as compared to the outward position). The outward position may be referred to as a closed position and the inward position may be referred to as an open position. The pivot levers 28 are pivotable along an arc A between the outward and inward positions. The pivot levers 28 are shown in the normal or resting positions in FIG. 2, with the exception of a pivot lever 28*a* that is shown in an inward position, which may correspond to a position in which one of the wires 16 is received in the housing 26 and mated with the corresponding electrical contact 22. The inward position may corresponding with the pivot lever 28*a* being pressed inward by an operator to release the wire 16 from the housing 26.

In the illustrated embodiment, the electrical wire 16 includes an electrical conductor 44 and an insulation layer 46 surrounding the electrical conductor 44. The insulation layer 46 has been stripped away at an end 48 of the electrical wire 16 to expose the electrical conductor 44 along the end 48. The electrical wire 16 is received within the selected wire channel 40 such that the exposed segment of the electrical conductor 44 is physically engaged in electrical connection with the corresponding electrical contact 22.

Figure 3:
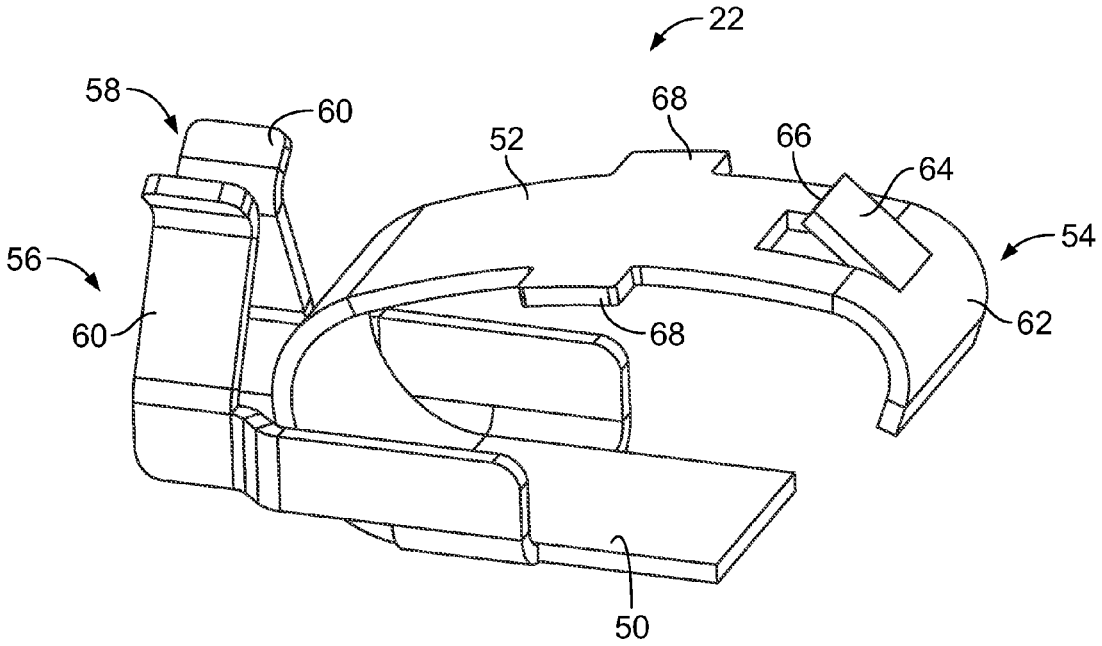
FIG. 3 is a perspective view of an electrical contact for the electrical connector formed in accordance with an exemplary embodiment.

FIG. 3 is a perspective view of one of the electrical contacts 22 in accordance with an exemplary embodiment. The electrical contact 22 includes a base 50 and a spring beam 52 extending therefrom. The spring beam 52 is configured to be electrically connected to the electrical wire 16 (shown in FIG. 2). The electrical contact 22 extends between a wire end 54 and a pin end 56. The electrical contact 22 is configured to engage the electrical wire 16 at the wire end 54 in a poke-in or pinching type of connection.

The pin end 56 includes a contact interface 58 at which the electrical contact 22 is configured to mate with the corresponding mating contact 20 (shown in FIG. 1) of the thermostat 12 (shown in FIG. 1). In the illustrated embodiment, the contact interface 58 includes opposing pin beams 60 that pinch the corresponding mating contact 20 therebetween to engage in physical contact with the mating contact 20 and thereby establish an electrical connection between the contacts 20, 22. The pin beams 60 oppose each other and are spring biased toward each other. When the mating contact 20 is inserted between the pin beams 60, the pin beams 60 spread apart and press against the mating contact 20 to ensure a reliable electrical connection between the electrical contact 22 and the mating contact 20. In the illustrated embodiment, the pin beams 60 extend from opposite sides of the base 50 and extend rearward of the spring beam 52 to the pin end 56.

The pin beams 60 may have other configurations in alternative embodiments. For example, in an alternative embodiment, rather than pin beams accepting the mating contact 20, the pin end 56 may include one or more pin beams, such as compliant pins or solder pins, which may be terminated to another device, such as a printed circuit board. The compliant pins or solder pins may extend downward through the housing 26 to mate with the printed circuit board. In such embodiments, rather than being terminated to a thermostat, the electrical contact 22 may be terminated to any type of printed circuit board.

The spring beam 52 is cantilevered from the base 50 and follows a generally arcuate path to a tip 62 at the wire end 54. The tip 62 is curved for mating with the electrical wire 16 and to prevent stubbing. In an exemplary embodiment, the spring beam 52 extends from a rear of the base 50 and is curved to extend forward of the base 50. As such, the spring beam 52 has a long effective length to provide good spring characteristics. When the spring beam 52 is deformed and flexed inward, such as when the electrical wire 16 is mated with the electrical contact 22, the spring beam 52 may be spring biased against the electrical wire 16. The long effective length reduces the risk of plastic deformation, thus insuring that the electrical contact 22 maintains the spring characteristics. The spring beam 52 may be curved or cupped at the wire end 54 to wrap at least partially around the pivot lever 28 (shown in FIG. 2).

In an exemplary embodiment, the spring beam 52 includes a burr 64 at the wire end 54. The burr 64 extends outward from the spring beam 52 to an edge 66. The burr 64 is configured to engage in physical contact with the electrical conductor 44 of the corresponding electrical wire 16. The burr 64 may or may not puncture the electrical conductor 44 of the corresponding electrical wire 16. The burr 64 may facilitate holding the corresponding electrical wire 16 to the electrical contact 22 (i.e., may facilitate maintaining the mechanical and electrical connection between the electrical conductor 44 of the corresponding electrical wire 16 and the electrical contact 22), for example via stiction between the burr 64 and the electrical conductor 44, via compression of the electrical conductor 44, and/or via puncturing of the electrical conductor 44. For example, the burr 64 may increase the force required to pull the corresponding electrical wire 16 out of the electrical connector 14.

In an exemplary embodiment, the electrical contact 22 includes retention tabs 68 extending outward from opposite sides of the spring beam 52. The retention tabs 68 are used to retain the mechanical connection between the electrical contact 22 and the pivot lever 28.

Figure 4:
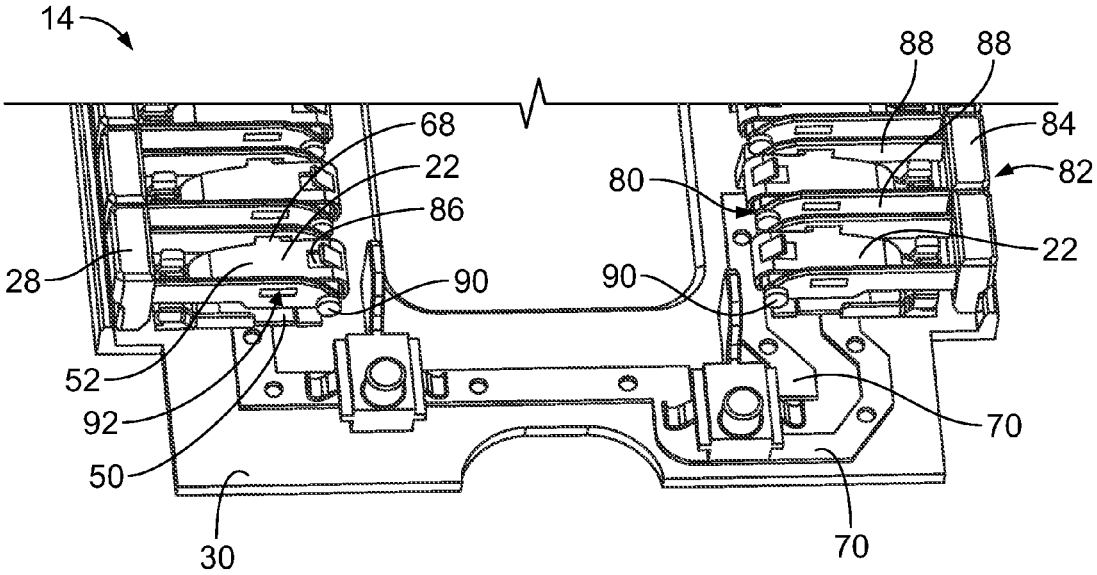
FIG. 4 is a prospective view of a portion of the electrical connector showing the electrical contacts and pivot levers of the electrical connector.

FIG. 4 is a perspective view of a portion of the electrical connector 14 with the cover plate 32 (shown in FIG. 2) removed to illustrate the electrical contacts 22 and pivot levers 28. In an exemplary embodiment, the electrical connector 14 includes one or more circuits 70 arranged in the base plate 30. Optionally, when the electrical contacts 22 are loaded in the base plate 30, the bases 50 of the electrical contacts 22 may be electrically connected to one or more of the circuits 70. In other embodiments, the circuits 70 may be provided in other components, such as a printed circuit board, and the electrical contacts 22 may be electrically connected to the circuits of the printed circuit board. For example, the bases 50 may be soldered to the printed circuit board. Alternatively, pins or beams may extend from the bases 50 that are terminated to the printed circuit board. The base plate 30 may include one or more guide or retention features that locate and/or retain the electrical contacts 22 in or on the base plate 30. The pivot levers 28 are coupled to corresponding electrical contacts 22.

The pivot levers 28 extend between a pivot end 80 and a push button end 82. The pivot end 80 is configured to be pivotably coupled to the housing 26, such as to the cover plate 32. The push button end 82 has a push button 84 configured to be pressed in a pressing direction, such as inward or toward the base plate 30, by an operator. For example, the push button 84 may be pressed to move the pivot lever 28 to a release position. As the pivot lever 28 is moved to the release position, the pivot lever 28 causes the electrical contact 22 to move to a clearance position, in which the electrical wire 16 (shown in FIG. 2) may be removed from the housing 26. The pivot lever 28 includes a beam 86 at the pivot end 80 that extends between a pair of arms 88 that extend rearward from the pivot end 80 to the push button 84 at the push button end 82. The arms 88 extend along the outside of the spring beam 52 of the electrical contact 22. Pivot posts 90 extend outward from the arms 88 at or near the pivot end 80. The pivot lever 28 is configured to pivot about the pivot posts 90. The arms 88 include openings 92 therethrough. The retention tabs 68 of the electrical contact 22 are received in corresponding openings 92. Optionally, the openings 92 may be elongated and have a width that is wider than the retention tabs 68 such that the retention tabs 68 may be able to slide forward and backward within the openings 92 as the spring beam 52 is moved and flexed. As such, the pivot lever 28 does not bind the electrical contact 22, such as when the electrical wire 16 is mated with the electrical contact 22 and/or when the pivot lever 28 releases the electrical contact 22.

Figure 5:
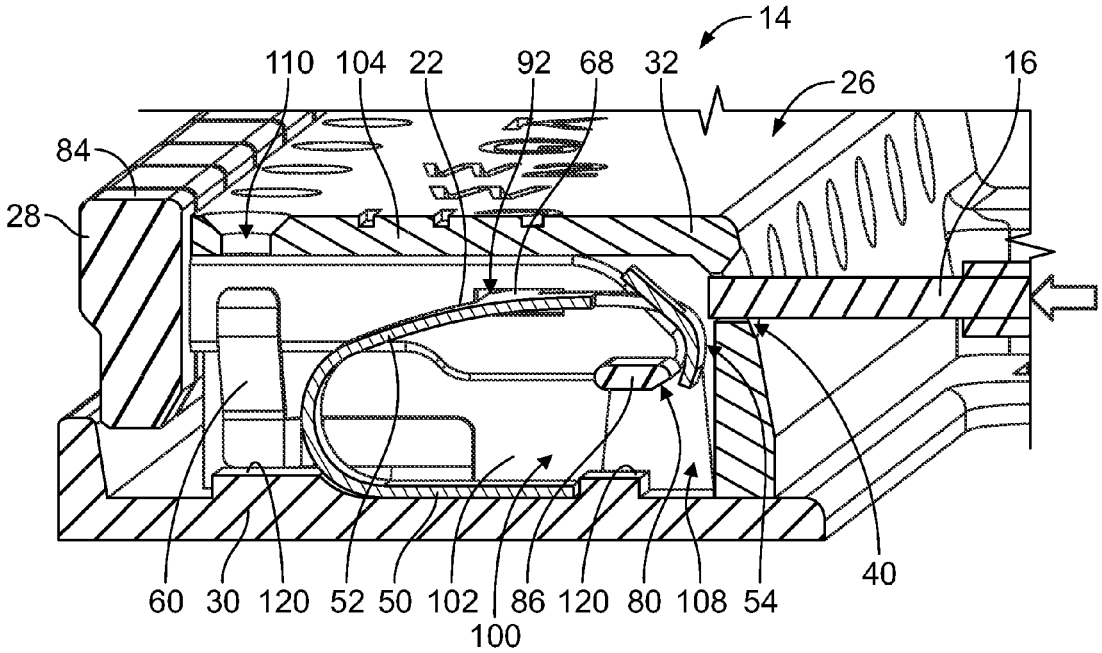
FIG. 5 is a cross sectional view of a portion of the electrical connector.

FIG. 5 is a cross sectional view of the electrical connector 14 showing an electrical wire 16 being poked into one of the wire channels 40 of the cover plate 32. The electrical contact 22 is positioned to receive the electrical wire 16. The pivot lever 28 is shown in the normal or outward position and the electrical contact 22 is shown in the resting position. The wire end 54 of the electrical contact 22 is aligned with the wire channel 40 such that the spring beam 52 interferes with loading of the electrical wire 16 into the wire channel 40. As such, as the electrical wire 16 is poked into the wire channel 40, the electrical wire 16 engages the spring beam 52 and forces the spring beam 52 to deflect inward. As the spring beam 52 deflects inward, the pivot lever 28 is similarly pivoted inward.

The cover plate 32 of the housing 26 includes a plurality of contact channels 100 formed therein. The electrical contacts 22 and pivot levers 28 are received in corresponding contact channels 100. The contact channels 100 are defined by separating walls 102 between adjacent contact channels 100. The contact channels 100 are defined at an outer end by an outer wall 104 of the cover plate 32. The outer wall 104 is opposite the base plate 30. The base plate 30 defines an inner wall of the contact channels 100. The wire channels 40 extend through a front wall of the cover plate 32 that defines a front of the contact channels 100. The wire channels 40 are open to corresponding contact channels 100 to allow the electrical wires 16 to pass into the contact channels 100 for mating with the electrical contacts 22. The pivot levers 28 extend out of the contact channels 100 to an exterior of the cover plate 32. The push buttons 84 are exposed exterior of the cover plates 32 such that an operator may press downward on the push button 84 to move the pivot lever 28 to the release position. In an exemplary embodiment, the separating wall 102 includes a pocket 108. The pivot posts 90 (shown in FIG. 4) are received in the pockets 108. The pivot posts 90 may pivotably engage the housing 26 within the pocket 108.

In an exemplary embodiment, the housing 26 includes a plurality of pin channels 110 that open to the contact channels 100. The pin channels 110 are configured to receive pins of the mating contacts 20 (shown in FIG. 1). In the illustrated embodiment, the pin channels 110 extend through the outer wall 104. The pin channels 110 are positioned near a rear of the cover plate 32. The electrical contacts 22 are positioned in contact channels 100 such that the pin beams 60 are aligned with the pin channels 110. As such, when the pins of the mating contacts 20 are loaded into the pin channels 110, the pins may be inserted between the pin beams 60 to make an electrical connection directly to the electrical contact 22.

The electrical contacts 22 are received in the contact channels 100 such that the base 50 extends along the base plate 30. The base plate 30 includes locating features 120 for positioning the electrical contact 22 in the contact channels 100. Portions of the electrical contact 22 engage the locating features 120 to position the electrical contact 22. The wire end 54 of the electrical contact 22 extends or wraps around the beam 86 at the pivot end 80 of the pivot levers 28. The retention tabs 68 extend into corresponding openings 92 of the pivot levers 28 to mechanically couple the electrical contact 22 to the pivot lever 28. As such, movement of the electrical contact 22, such as when the spring beam 52 is flexed inward during mating with the electrical wire 16, causes corresponding movement of the pivot lever 28, such as to an inward position. Similarly, movement of the pivot lever 28 may be transferred to the electrical contact 22, such as when the pivot lever 28 is pushed to the release position, the pivot lever 28 may cause the spring beam 52 to flex inward to a clearance position to allow the electrical wire 16 to be removed from the housing 26.

Figure 6:
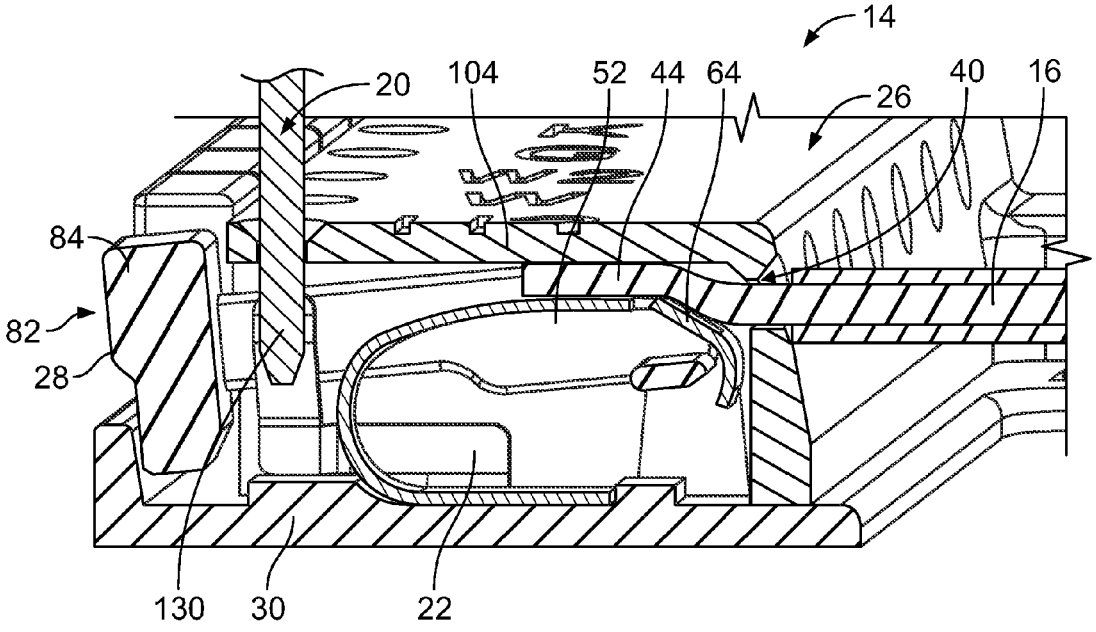
FIG. 6 is a cross sectional view of a portion of the electrical connector.

FIG. 6 is a cross sectional view of the electrical connector 14 showing the electrical contact 22 terminated to the electrical wire 16 and showing a pin 130 of the mating contact 20 electrically connected with the electrical contact 22. The electrical contact 22 defines a direct electrical path between the mating contact 20 and the electrical wire 16. The electrical contact 22 is a single piece, unitary structure that defines a conductive path between the mating contact 20 and the electrical wire 16.

During insertion or poke-in of the electrical wire 16 into the housing 26, the electrical wire 16 forces the electrical contact 22 to flex or move inward toward the base plate 30. The spring beam 52 presses outward against the electrical wire 16 sandwiching or pinching the electrical wire 16 between the spring beam 52 and the outer wall 104. The spring beam 52 is spring biased against the electrical wire 16 to ensure a reliable electrical connection between the electrical contact 22 and the electrical wire 16. The burr 64 may engage or dig into the electrical conductor 44 of the electrical wire 16.

When the electrical contact 22 is flexed inward to a pinching position, the pivot lever 28 is likewise moved inward. For example, the push button end 82 may be pivoted inward toward the base plate 30 to a deflected position. In the deflected position, the push button 84 is located inward relative to push buttons 84 that are in the normal or resting position. As such, a visual indication that the pivot lever 28 has been pivoted or moved inward indicates that the electrical wire 16 is properly positioned in the corresponding wire channel 40 and is in electrical connection with the electrical contact 22.

Figure 7:
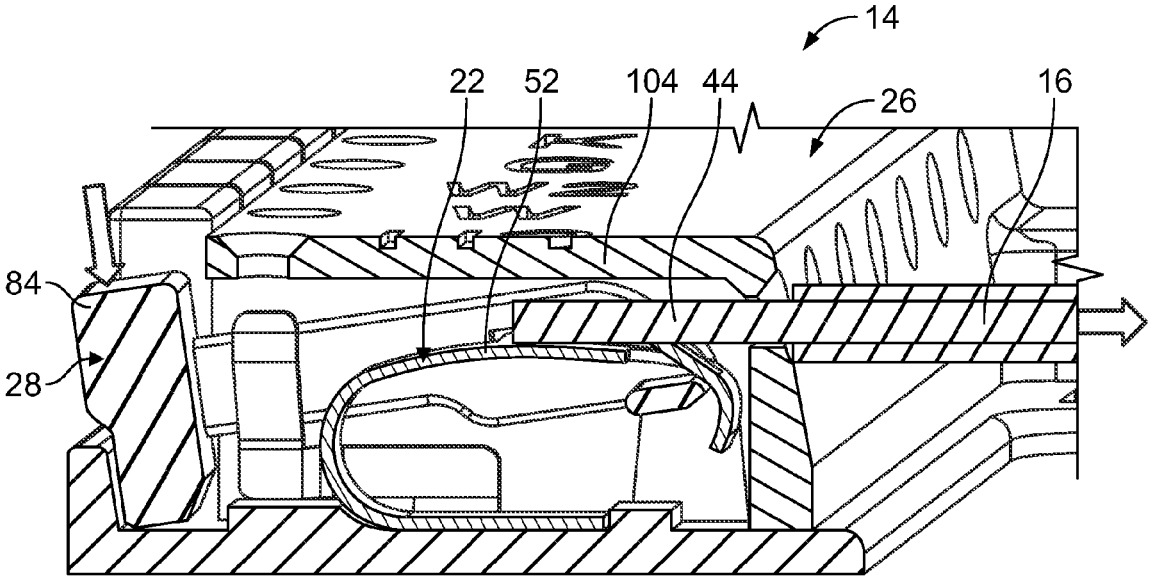
FIG. 7 is a cross sectional view of a portion of the electrical connector.

FIG. 7 is a cross sectional view of the electrical connector 14 showing the pivot lever 28 in the release position. The push button 84 may be pressed in a pressing direction by an operator to move the pivot lever 28 to the release position. As the pivot lever 28 is moved inward, the electrical contact 22, which is coupled to the pivot lever 28, is similarly flexed or moved inward. The electrical contact 22 is moved to a clearance position in which clearance is provided between the spring beam 52 and the outer wall 104 to allow the electrical wire 16 to be pulled out of the housing 26. Once the electrical wire 16 is removed from the housing 26, the push button 84 may be released and the spring beam 52 may return to the normal or resting position, which forces the pivot lever 28 to pivot to the normal or resting position.

The pinch connection between the spring beam 52 and the electrical conductor 44 of the corresponding electrical wire 16 is optionally a separable connection. A "separable connection" is a connection wherein the corresponding electrical wire 16 can be terminated by the electrical contact 22 without damaging the electrical contact 22 and/or without damaging the electrical wire 16. For example, a "separable connection" may be a connection wherein: (1) the corresponding electrical wire 16 can be installed to the electrical contact 22 (i.e., captured between the spring beam 52 with the compliant pinch connection) and later uninstalled from the electrical contact 22 (i.e., removed from between the spring beam 52 and the outer wall 104) without damaging the electrical contact 22 such that another electrical wire 16 can be installed to the electrical contact 22; and/or (2) the corresponding electrical wire 16 can be installed in the same or another location.

Optionally, the spring beam 52 is compliant and flexible to enable the electrical contact 22 to accommodate a larger range of sizes of electrical wires. For example, the electrical contact 22 may be capable of accommodating at least four different sizes of electrical wires, such as, but not limited to, between 18-24 AWG.

Terminating an electrical wire with the compliant pinch connection of the electrical contacts 22 may require less force to achieve as compared to at least some other known connection types, for example as compared to terminating an electrical wire using an insulation displacement design (IDC) contact. In other words, it may require less force to pivot the spring beam 52 and pivot lever 28 open when the electrical wire 16 is poked-in to the housing 26 and thereby terminate electrical wires 16 as compared to the pivot blocks of at least some known pivot block style connectors, for example as compared to pivot block style connectors that use IDC contacts.

The embodiments described and/or illustrated herein may provide a poke-in style connector that can accommodate (i.e., terminate with a reliable electrical connection) a larger range of different sizes of electrical wires as compared to at least some known pivot block style connectors. The embodiments described and/or illustrated herein may provide a poke-in style connector that may require less force to terminate electrical wires as compared to at least some known pivot style connectors. The embodiments described and/or illustrated herein may provide a poke-in style connector that includes a single piece contact to make an electrical connection between an electrical wire and a mating contact, such as a mating contact of a thermostat.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having contact channels and wire channels open to corresponding contact channels, the wire channels being configured to receive an electrical wire during a poke-in termination;

electrical contacts received in corresponding contact channels and held by the housing, each electrical contact comprising a poke-in spring beam configured to engage the electrical wire when poked-in to the corresponding wire channel in a loading direction, the spring beam having a separable wire interface configured to engage in physical contact with the electrical wire, the electrical contact being movable between a resting position when no wire is present in the wire channel and a clearance position where the electrical contact allows the electrical wire to be removed from the wire channel, wherein each electrical contact includes pin beams configured to receive therebetween to pinch and electrically mate with a pin of a mating contact to electrically connect the electrical wire to the pin, the pin beams receiving the pin in a mating direction generally perpendicular to the loading direction, wherein each electrical contact is part of a different circuit and configured to mate with the pin of the corresponding mating contact;

pivot levers held by the housing and being coupled to corresponding electrical contacts, the pivot levers moving with the corresponding electrical contacts, wherein the electrical contacts include tabs extending from the spring beams and wherein each pivot lever includes at least one opening for receiving at least one corresponding tab to mechanically couple the electrical contacts to the corresponding pivot levers to allow coordinated movement of the electrical contacts with the corresponding pivot levers, each pivot lever extending between a pivot end and a push button end, the pivot end being pivotably coupled to the housing, the push button end having a push button configured to be pressed in a pressing direction by an operator to move the corresponding electrical contact to the clearance position; and wherein, when the electrical wire is loaded into the wire channel, the electrical contact is positioned in a pinching position between the clearance position and the resting position in which the spring beam pinches against the electrical wire in physical contact with the electrical wire.

2. The electrical connector of claim 1, wherein the pin beams are positioned between the spring beam and the push button.

3. The electrical connector of claim 1, wherein the pin beams is configured to be terminated directly to the pin extending from a printed circuit board to electrically connect the electrical wire to the printed circuit board.

4. The electrical connector of claim 1, wherein the housing includes an outer wall defining the contact channels, the spring beam configured to pinch the electrical wire between the separable wire interface and the outer wall.

5. The electrical connector of claim 1, wherein the electrical contacts is configured to be pushed to the pinching position by the electrical wire when the electrical wire is loaded into the wire channel.

6. The electrical connector of claim 1, wherein the pivot lever is normally positioned in an outward position and held in the outward position by the electrical contact when the electrical contact is in the resting position, the push button being recessed to an inward position when the electrical contact is flexed to the pinching position.

7. The electrical connector of claim 1, wherein the push button being positioned immediately adjacent a pin channel of the housing configured to receive a corresponding pin to electrically connect the electrical contact to the mating contact, the pin beams having contact interfaces configured to engage in physical contact with the pin.

8. An electrical connector comprising:

a housing having contact channels and wire channels open to corresponding contact channels, the wire channels being configured to receive an electrical wire during a poke-in termination;

electrical contacts received in corresponding contact channels and held by the housing, each electrical contact comprising a poke-in spring beam configured to engage the electrical wire when poked-in to the corresponding wire channel, the spring beam having a separable wire interface configured to engage in physical contact with the electrical wire, wherein the electrical contact includes tabs extending from the spring beam, and wherein the electrical contact being movable between a resting position when no wire is present in the wire channel and a clearance position where the electrical contact allows the electrical wire to be removed from the wire channel; and pivot levers held by the housing and being coupled to corresponding electrical contacts, the pivot levers moving with the corresponding electrical contacts, each pivot lever includes at least one opening receiving corresponding tabs to mechanically couple the electrical contact to the pivot lever to allow coordinated movement of the electrical contact with the pivot lever, each pivot lever extending between a pivot end and a push button end, the pivot end being pivotably coupled to the housing, the push button end having a push button configured to be pressed in a pressing direction by an operator to move the corresponding electrical contact to the clearance position;

wherein, when the electrical wire is loaded into the wire channel, the electrical contact is positioned in a pinching position between the clearance position and the resting position in which the spring beam pinches against the electrical wire in physical contact with the electrical wire.

9. The electrical connector of claim 8, wherein the openings are elongated and wider than the tabs to allow sliding movement between the electrical contact and the pivot lever during flexing of the spring beam.

10. The electrical connector of claim 8, wherein the pivot lever includes a pair of arms flanking opposite sides of the spring beam, each of the arms includes a corresponding opening receiving a corresponding tab of the spring beam.

11. The electrical connector of claim 1, wherein the push button is configured to be pressed in the pressing direction to move the pivot lever to a release position, the pivot lever causing the electrical contact to move to the clearance position when the pivot lever is in the release position.

12. The electrical connector of claim 1, wherein at least one of the spring beams of the electrical contact comprises a burr configured to engage in physical contact with the electrical wire.

13. The electrical connector of claim 1, wherein the electrical contact is configured to be engaged in physical contact with a printed circuit through the corresponding pin beam of the mating contact electrically connected to the printed circuit such that the electrical contact is electrically connected to the printed circuit.

14. A thermostat assembly comprising:

a thermostat comprising a printed circuit having mating contacts; and an electrical connector configured to be mated with the thermostat, the electrical connector comprising;

a housing having contact channels and wire channels open to corresponding contact channels, the wire channels being configured to receive an electrical wire during a poke-in termination;

electrical contacts received in corresponding contact channels and held by the housing, each electrical contact comprising a poke-in spring beam configured to engage the electrical wire when poked-in to the corresponding wire channel, the spring beam having a separable wire interface configured to engage in physical contact with the electrical wire, the electrical contact being movable between a resting position when no wire is present in the wire channel and a clearance position where the electrical contact allows the electrical wire to be removed from the wire channel, the electrical contact comprising pin beams directly electrically connected to the corresponding mating contact; and pivot levers held by the housing and being coupled to corresponding electrical contacts, the pivot levers moving with the corresponding electrical contacts, each pivot lever having a pair of arms extending between a pivot end and a push button end, the arms extending along the outside of the spring beam and of the pin beams such that the spring beam and the pin beams are positioned between the arms, the pivot end being pivotably coupled to the housing, the push button end having a push button configured to be pressed in a pressing direction by an operator to move the corresponding electrical contact to the clearance position;

wherein, when the electrical wire is loaded into the wire channel, the electrical contact is positioned in a pinching position between the clearance position and the resting position in which the spring beam pinches against the electrical wire in physical contact with the electrical wire.

15. The thermostat assembly of claim 14, wherein the electrical contact has a single piece unitary body comprising the spring beam and pin beams configured to mate with a pin of a mating contact to electrically connect the electrical wire to the pin, the spring beam being compliant to provide a spring biasing force sufficient to ensure physical engagement with the electrical wire.

16. The thermostat assembly of claim 14, wherein the housing includes an outer wall defining the contact channels, the spring beam configured to pinch the electrical wire between the separable wire interface and the outer wall.

17. The thermostat assembly of claim 14, wherein the pivot lever is normally positioned in an outward position and held in the outward position by the electrical contact when the electrical contact is in the resting position, the push button being recessed to an inward position when the electrical contact is flexed to the pinching position.

18. The thermostat assembly of claim 14, wherein the pin beams are positioned between the spring beam and the push button.

19. The thermostat assembly of claim 14, wherein the electrical contact includes tabs extending from the spring beam, the pivot lever includes openings receiving corresponding tabs to mechanically couple the electrical contact to the pivot lever to allow coordinated movement of the electrical contact with the pivot lever.

* * * * *